United States Patent [19]

Hinago

[11] 4,111,091

[45] Sep. 5, 1978

[54] TOUCH RESPONSE SENSOR FOR AN ELECTRONIC MUSICAL INSTRUMENT

[75] Inventor: Yasuhiro Hinago, Hamamatsu, Japan

[73] Assignee: Nippon Gakki Seizo Kabushiki Kaisha, Japan

[21] Appl. No.: 762,559

[22] Filed: Jan. 25, 1977

[30] Foreign Application Priority Data

| | | | |
|---|---|---|---|
| Jan. 30, 1976 | [JP] | Japan | 51-9356[U] |
| Apr. 19, 1976 | [JP] | Japan | 51-48948[U] |
| May 6, 1976 | [JP] | Japan | 51-56733[U] |
| May 6, 1976 | [JP] | Japan | 51-56734[U] |

[51] Int. Cl.[2] ..... G10H 1/00; G10C 3/12

[52] U.S. Cl. ..... 84/1.01; 84/437; 84/DIG. 7; 200/159 B

[58] Field of Search ..... 84/1.01, 1.26, DIG. 7, 84/433–435, 1.17; 200/159 B, 264; 338/5, 71, 96, 97, 114, 125; 340/365 R, 365 A, 365 S, 365 C, 366 B

[56] References Cited

U.S. PATENT DOCUMENTS

| | | | |
|---|---|---|---|
| 1,203,621 | 11/1916 | Hope-Jones | 84/433 |
| 2,959,693 | 11/1960 | Meyer | 84/1.01 |
| 3,590,130 | 6/1971 | Peli | 84/1.01 |
| 3,845,683 | 11/1974 | Lehmann | 84/DIG. 7 |
| 4,039,068 | 8/1977 | Giorza et al. | 235/145 R |

FOREIGN PATENT DOCUMENTS

| | | | |
|---|---|---|---|
| 922,982 | 4/1963 | United Kingdom | 338/5 |

*Primary Examiner*—Edith S. Jackmon

*Attorney, Agent, or Firm*—Ladas, Parry, Von Gehr, Goldsmith & Deschamps

[57] ABSTRACT

This invention relates to a touch response sensor for an electronic musical instrument capable of producing a signal responsive to a key depressing speed upon depression of a key. In order to produce such a signal from the sensor, the latter comprises two switches which are operated in turn by a single drive piece with a time lag determined by the key depressing speed. The secondarily operated switch may be a switch capable of producing a signal responsive to a key depressing pressure and including a resistant member and a resilient member having a conductive portion facing the resistant member thereby, upon depression of the resilient member through the key, to produce a resistance variation signal responsive to the key depressing pressure.

7 Claims, 18 Drawing Figures

TOUCH RESPONSE SENSOR FOR AN ELECTRONIC MUSICAL INSTRUMENT

BACKGROUND OF THE INVENTION

This invention relates to a touch response sensor for an electronic musical instrument and, more particularly, to a touch response sensor which produces a signal responsive to the key depressing speed and pressure upon depression of the key.

A keyboard type electronic musical instrument is generally constructed not only to open or close a tone signal source by the key depressing pressure but to control the amplitude of the tone signal in response to the key depressing speed and depressing pressure so as to add a touch response effect i.e., an initial control effect and/or an after-control effect to the instrument.

Heretofore, there was a touch control sensor employing a leaf switch 1 as a switch mechanism for initial control of keys for the instrument utilizing a contact time difference detecting system as shown in FIG. 1, which switch 1 has a movable leaf contact piece 2 driven by a key(not shown) of the instrument, and stationary leaf contact pieces 3 and 4 This leaf switch 1 is connected to a charging and discharging circuit (not shown) composed of condensers, resistors, a power source, etc., and is constructed such that the movable leaf contact piece 2 is separated from the contact 3*a* of the stationary leaf contact piece 3 upon depression of the key so as to start discharging operation, so that the voltage at the time when the movable contact piece 2 is contacted to the contact 4*a* of the stationary contact piece 4 is held by a peak hold circuit (not shown), resulting in obtaining a tone generation signal based on such a voltage signal. This circuit arrangement is so operated that the stronger the key depressing pressure is, i.e., the longer the key depressing speed is, the higher the peak-hold voltage is maintained. Thus, the initial control of the key for the instrument is conducted by detecting a period of from separation of the movable contact piece 2 from the stationary contact piece 3*a* to contacting of the contact piece 2 with the stationary contact piece 4*a*. However, the aforedescribed leaf switch mechanism requires high accuracy in bending work of the respective leaf contact pieces resulting in difficulty in manufacturing thereof. Other problems reside in production, check and maintenance of the switch such that even a casual finger touch on the leaf contact pieces exceeds the elastic limit of the contact pieces resulting in deformation of the pieces, and, accordingly treatment or manipulation of the switch requires great care. Furthermore, since the intrinsic or characteristic frequency of the leaf contact pieces themselves is high, it has such disadvantage that a chattering occurs at the switching operations of the switch.

There have heretofore been developed various touch response sensors for generating a signal responsive to the key depressing pressure required for the providion of the touch response effect, especially the after-control effect by utilizing a piezo-electric element, an electromagnetic induction, change in contacting resistance, etc., but any of these sensors had disadvantages such as expensive cost, complicated construction resulting in difficulty for miniaturization thereof, and accordingly satisfactory components could not be obtained for the conventional touch response sensors in every key of the musical instrument.

SUMMARY OF THE INVENTION

It is, therefore, an object of this invention to provide a touch response sensor for an electronic musical instrument of a remarkably reliable construction less expensively.

It is another object of the invention to provide a touch response for an electronic musical instrument capable of providing a desirable initial control by accurately detecting the key depressing speed or time required for contacting of the switches in the sensor.

It is another object of the invention to provide a touch response sensor for an electronic musical instrument capable of extemely easy assembling, checking and maintenance of the sensor. It is another object of the invention to provide a touch respnse sensor for an electronic musical instrument capable of preventing chattering by employing a member of extremely low intrinsic or characteristic frequency in the respective switches of the sensor.

It is another object of the invention to provide a switch in a touch response sensor for an electronic musical instrument capable of producing a signal responsive to the key depressing pressure by varying the contacting area of the resistant members with the conductive member by depressing a conical resilient member arranged on the resistant members upon depression of the key, so as to provide an after-control-effect.

It is another object of the invention to provide a switch in a touch response sensor for an electronic musical instrument capable of directly disposing the sensor on a base plate in a simplified manner.

It is still another object of the invention to provide a touch response sensor for an electronic musical instrument adapted for mass production with high accuracy.

Other objects and features of the invention will become apparent from the description made hereinbelow with reference to the accompanying drawings.

BRIEF DESCRIPTION OF THE DRAWINGS

FIG. 10(*b*) is a plan view of the switch shown in FIG. 10(*a*);

DESCRIPTION OF THE PREFERRED EMBODIMENTS

Figure 1:
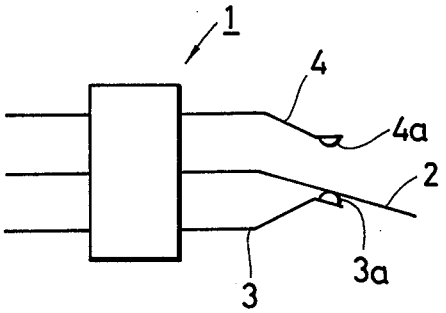
FIG. 1 PRIOR ART
FIG. 1 is a schematic view of a leaf switch used for the prior art touch response mechanism.
Figure 2:
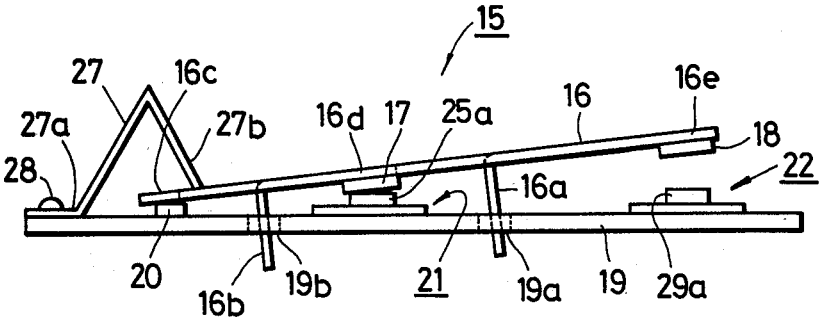
FIG. 2 is a side view showing one embodiment of the touch response sensor for the musical instrument of this invention.

Referring first to FIG. 2, there is shown one embodiment of the touch response sensor according to the present invention. The touch response sensor of this embodiment comprises a drive piece 16 of rectangular shape which has two guide portions **16*a* and 16*b* formed by notching and bending up integral portion thereof in such a manner that the guide portion 16*a* is slightly longer than the guide portion 16*b***. This drive piece is, for example, made of iron sheet or the like having a strength to the extent that even if a depressing pressure as will be described later is applied thereto it may not easily be deformed in bent manner.

Cushion members 17 and 18 are fixedly secured or adhered underneath substantially central portion **16*d* and end portion 16*e* of the drive piece 16**, and may be made of resilient or elastic material such as rubber or the like.

The sensor of this embodiment has a base plate 19 which has holes **19*a* and 19*b* at the positions corresponding to those of the guide portions 16*a* and 16*b* in such a manner that the guide portions 16*a* and 16*b* of the guide piece 16 may be disengageably inserted therethrough, and a supporting member 20 fixedly secured onto the base plate 19 on the side of the hole 19*b* by a predetermined distance from the hole 19*b*. This supporting member 20** may be made of a resilient material such as rubber.

The sensor of this embodiment has switches 21 and 22 arranged onto the base plate 19 in facing relationship with the cushion members 17 and 18. In this arrangement, the holes **19*a* and 19*b*, the supporting member 20 and the switches 21 and 22** are arranged on the same rectilinear line.

Figure 3:
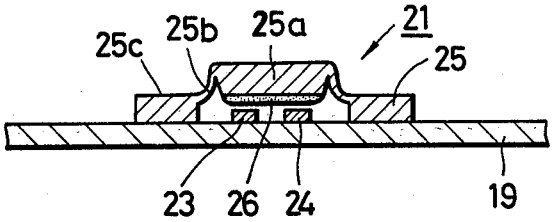
FIG. 3 is a sectional view of a switch used in the sensor shown in FIG. 2.

As shown in FIG. 3, which shows the sectional view of the switch 21, the switch 21 has stationary contact pieces 23 and 24 formed on the base plate 19 such as by a sprinting or the like, and a movable contact 25 arranged above the contact pieces 23 and 24. This movable contact portion **25*a* of the contact piece 25 is disposed substantially at the center of the switch 21 and is connected through a thin side wall 25*b* extended downwardly therefrom to the base portion 25*c* and around the contact portion 25*a*. The contact piece 25 is integrally formed, for example, of a resilient material such as rubber. The switch 21 also has a conductive portion 26 formed underneath the movable contact portion 25*a*. This conductive portion 26 is formed, for example, of conductive rubber, carbon, silver, etc., adhered thereto. The movable contact piece 25 is so placed or arranged on the base plate 19 that the conductive portion 26 faces in spaced velationship with the stationary contact pieces 23 and 24, and the base portion 25*c* is engaged in contact with the base plate 19**.

In the state that the movable contact portion **25*a* of the switch 21 thus constructed is not depressed, the movable contact piece 25*a* is maintained at the upper position by the resilient tension of the side wall 25*b* as shown in FIG. 3, so that the conductive portion 26 is separated in space upwardly from the stationary contact pieces 23 and 24 with the result that the switch 21** is at off position.

When the movable contact portion **25*a* is depressed, the side wall 25*b* is bent downwardly by the depressing pressure, so that the movable contact portion 25*a* is accordingly moved downwardly with the result that the conductive portion 26 is contacted with the stationary contact pieces 23 and 24 to cause the switch 21** to become at on position.

Upon release of the depressing pressure from the switch 21 the movable contact piece **25*a* is moved upwardly by means of the resilient tension of the side wall 25*b* resulting in the off position of the switch 21**.

It is to be noted that the respective stationary contacts 23 and 24 are connected through lines (not shown) to a predetermined electric circuit (not shown).

It should be appreciated from the foregoing description that since the conductive portion 26 of the switch has a resiliency as described above, its characteristic frequency is extremely low, and accordingly no chattering occurrs when contacted with the stationary contact pieces 23 and 24. It is to be noted that the switch 22 may be also constructed similarly to the switch 21 as a whole.

Referring now back to FIG. 2, the aforesaid drive piece 16 is arranged on the base plate 19 in such a manner that the guide portions **16*a* and 16*b* thereof are inserted into the holes 19*a* and 19*b*, respectively of the base plate 19 and that the end 16*c* thereof is positioned on the supporting member 20. The drive piece 16 is engaged at the vicinity of its end 16*c* by a spring 27 which is formed substantially in inverted L-shape bent from a leaf spring. One end 27*a* of the spring 27 is fixed through a grommet 28 onto the base plate 19, and the other end 27*b* of the spring 27 is depressed in contact on one end 16*c* of the drive piece 16. Accordingly, the drive piece 16 is held in engagement by the resilient pressure of the spring 27 with the guide portions 16*a* and 16*b* of the guide piece 16 inserted into the respective holes 19*a* and 19*b* of the base plate 19. Thus, the switch mechanism 15** for the touch response sensor is thus constructed as shown in FIG. 2.

In the state that the drive piece 16 is not depressed as an ordinal condition, the movable contact portions **25*a* and 29*a* of the switches 21 and 22, respectively are maintained at the upper position by means of the resilient tension of the side wall 25*b* and 29*b* (29*b*: not shown) as shown in FIG. 2 to cause the switches 21 and 22 to become in off state. In this state, the drive piece 16 is biased in counterclockwise direction on the supporting member 20 through the cushion member 17 by means of the movable contact portion 25*a* of the switch 21** as shown in FIG. 2.

Figure 4:
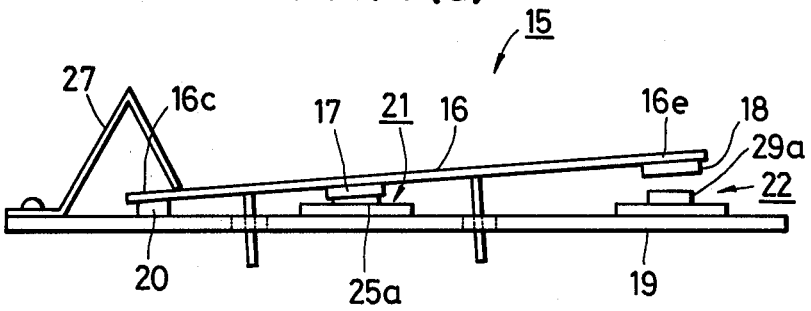
FIGS. 4(*a*) and 4(*b*) are side views for explaining the operation of the sensor shown in FIG. 2.
Figure 4:
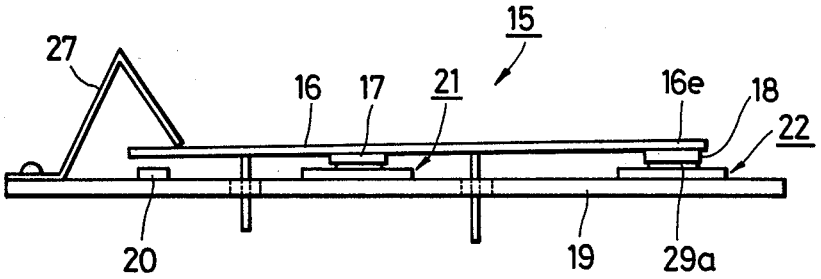

Assuming now that the end **16*e* of the drive piece 16 is depressed, the drive piece 16 is pivoted in clockwise direction on the supporting member 20 to allow the movable contact portion 25*a* of the switch 21 to be depressed through the cushion member 17. Accordingly, the movable contact portion 25*a* is moved downwardly as previously described, so that the conductive portion 26(FIG. 3) is contacted to the stationary contact pieces 23 and 24 to render the switch 21** for becoming in on state, as shown in FIG. 4(*a*). In such state, the cushion member 18 is separated upwardly of the movable contact piece **29*a* of the switch 22 to permit the switch 22** to be in off state.

Upon further depression of the drive piece 16 the drive piece 16 is now pivoted in clockwise direction against the spring 27 on the movable contact portion 25*a* of the switch 21. As the drive piece 16 is thus rotated, the cushion member 18 will depress the movable contact piece 29*a* of the switch 22 to cause the switch 22 to become in on state similarly to the switch 21 as described above as shown in FIG. 4(*b*). Therefore, both the switches 21 and 22 are closed on in this state.

The time period T from the time point when the switch 21 becomes on as in FIG. 4(*a*) to the time point when the switch 22 becomes on as in FIG. 4(*b*) thus varies in accordance with the rotating speed of the drive piece 16. It is to be noted that in cause wherein excessive depressing pressure is applied to the drive piece 16 the cushion members 17 and 18 will absorb this pressure so as to protect the switches 21 and 22 together with the drive piece 16 being prevented from bounding.

Upon release of the depressing pressure on the drive piece 16, the drive piece 16 is rotated in counterclockwise direction on the movable contact piece 25*a* of the switch 21 by means of the resilient tension of the spring 27 and the upward returning force of the side wall 29*b* (not shown) of the movable contact piece 29*a* of the switch 22 to allow the switch 22 to become off.

The drive piece 16 is then rotated further in counterclockwise direction on the supporting member 20 by the upward returning force of the side wall 25*b* of the movable contact portion 25*a* of the switch 21 to render the switch 21 for becoming off so as to return to the original state as shown in FIG. 2.

Figure 5:
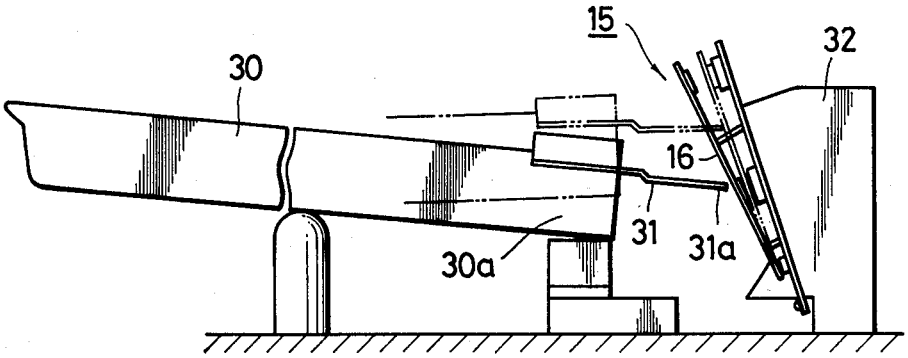
FIG. 5 is a partial view showing the sensor in FIG. 2 installed in an electronic musical instrument.

FIG. 5 shows one embodiment of the touch response sensor of the key for the instrument employing the switch mechanism 15 as described and disclosed above.

An actuator 31 is fixedly secured to the end 30*a* of the key 30 of the electronic musical instrument, and the switch mechanism 15 is arranged through the supporting member 32 at the rear of the actuator 31 as shown.

In the state that the key 30 is not depressed, the actuator 31 is arranged at a slight gap with the drive piece 16 at the end 31*a* thereof to cause the switches 21 and 22 to be off.

Upon depression of the key 30, the actuator 31 is rotated in counterclockwise direction, so that the end 31*a* of the actuator 31 is slidably moved to depress the drive piece 16 thereon as designated by two-dotted broken lines in FIG. 5. Accordingly, the drive piece 16 is successively rotated in clockwise direction on the movable contact portion 25*a* of the switch 21 and the supporting member 20 as previously described to cause the switches 21 and 22 to become sequentially on.

The time period T from the time point when the switch 21 becomes on to the time point when the switch 22 becomes on will vary in response to the rotating speed of the actuator 31, i.e., to the strength of the key depressing pressure of the key 30. More specifically, when the key depressing pressure is strong, the time period T is short, while when the key depressing pressure is weak, the time period T becomes long.

When the actuator 31 is slidably moved on the drive piece 16, the actuator 31 is subject to the resilient force imparted by the side walls 25*b* and 29*b* of the respective contact portions 25*a* and 29*a* of the switches 21 and 22 at respective switching times and by the spring 27.

It is not the entire resilient force of the drive piece 16 that is exercised on the actuator 31 in the key depressing direction but only a partial force component of such resilient force, and, accordingly, the reaction of the spring 27 is reduced. Thus, the touch response of the key produced by the conventional key supporting mechanism in which the key is supported by a spring at the rear end of the key in depression of the key has been replaced by an extremely good touch response.

Upon release of the key depressing pressure of the key 30 the actuator 31 is rotated in clockwise direction in downward direction in FIG. 5 while sliding on the drive piece 16 to allow the actuator 31 to be sequentially separated from the drive piece 16. Therefore, the drive piece 16 is rockably rotated in counterclockwise direction by the returning force of the movable contact pieces 25*a* and 29*a* and the spring 27 as described above to cause the switches 21 and 22 to become sequentially off to the original state.

Thus, the time period T from the time point when the switch 21 becomes on to the time point when the switch 22 becomes on can be detected, and the initial control of the key 30 can be conducted based on the contact time T as aforementioned.

Figure 6:
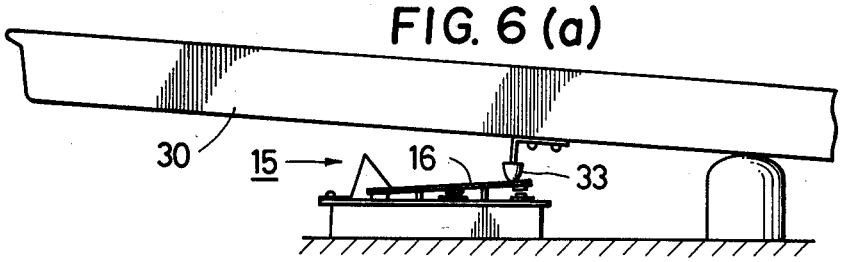
FIGS. 6(*a*) and 6(*b*) are views of other installation arrangements for touch response sensor of this invention.
Figure 6:
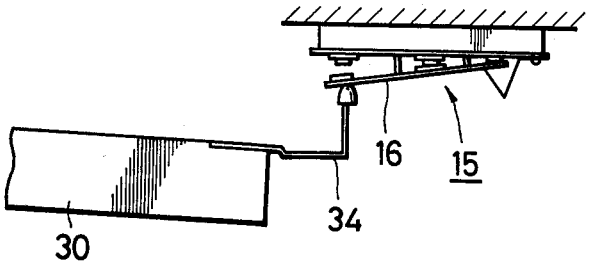

FIGS. 6(*a*) and 6(*b*) show another embodiment of the touch response sensor, wherein the same component parts as those shown in FIG. 2 are denoted by the same reference characters and description thereof is omitted.

Actuators 33 and 34 fixedly secured to the key 30 will directly depress the drive piece 6 of the switch mechanism 15 to cause the switches 21 and 22 to become on.

Figure 7:
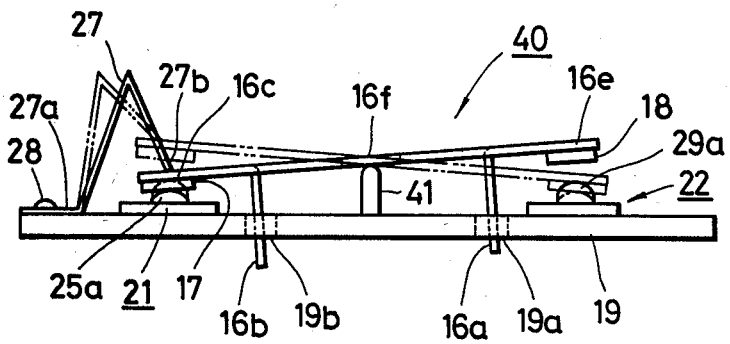
FIG. 7 is a side view similar to FIG. 2 but showing another embodiment of the invention.

FIG. 7 shows another embodiment of the switch mechanism used for the touch response sensor, wherein the same component parts as those shown in FIG. 2 are denoted by the same reference characters and description thereof is omitted.

The cushion members 17 and 18 are fixedly secured or adhered underneath both ends 16*c* and 16*d* of the drive piece 16. The supporting member 41 is fixedly secured onto the base plate 19 at substantially intermediate between the holes 19*a* and 19*b* of the base plate 19, and will become a fulcrum when the drive piece 16 is rockably rotated, and has a circular upper end made of hard rubber or the like.

In the state that the drive piece 16 is not depressed as an ordinal condition, the drive piece 16 is rotated in counterclockwise on the supporting member 41 by mean of the depressing pressure of the spring 27 so as to depress the movable contact piece 25*a* of the switch 21 through the cushion member 17. Accordingly, the switch 21 becomes on. On the other hand, the other end 16*e* of th drive piece 16 is upwardly moved, the cushion member 18 is positioned at the upper position of the movable contact piece 19*a* of the switch 22 to cause the switch 22 to become off. More specifically, the switch mechanism 40 is so arranged in its ordinal condition that the switch 21 becomes on while the switch 22 becomes off.

Assuming that the end 16*e* of the drive piece 16 is depressed against the spring 27, the drive piece 16 is rotated in clockwise direction on the supporting member 41 as a fulcrum, so that the end 16*c* of the drive piece 16 is moved upwardly with the result that the cushion member 17 is separated from the movable contact piece 25*a* of the switch 21. Accordingly, the movable contact piece 25*a* is moved upwardly by means of the resilient tension of the side wall 25*b* to render the switch for being off.

Assuming that the rotation of the drive piece 16 is further advanced in clockwise direction and the end 16*e* of the drive piece 16 depresses downwardly the movable contact piece 29*a* of the switch 22 via the cushion member 18, the switch 22 becomes on similarly to the switch 21 as described above, as designated by two-dotted broken line in FIG. 7.

The time period T from the time point when the switch 21 becomes off to the time point when the switch 22 becomes on will vary according to the rotating speed of the drive piece 26.

Upon release of the depressing pressure on the drive piece 16 the drive piece 16 is reversely rotated in counterclockwise direction by means of the resilient tension of the spring 27 to cause the end 16*e* of the drive piece 16 to be moved upwardly so that the cushion member 18 is separately moved upwardly from the movable contact piece 29*a* of the switch 22, while the end 16*c* of the drive piece 16 is moved downwardly so as to depress the movable contact piece 25*a* of the switch 21 via the cushion member 27, as shown in FIG. 7. Therefore, the switch 22 becomes off, while the switch 21 becomes on, and the switch mechanism 15 is returned to the original position.

Figure 8:
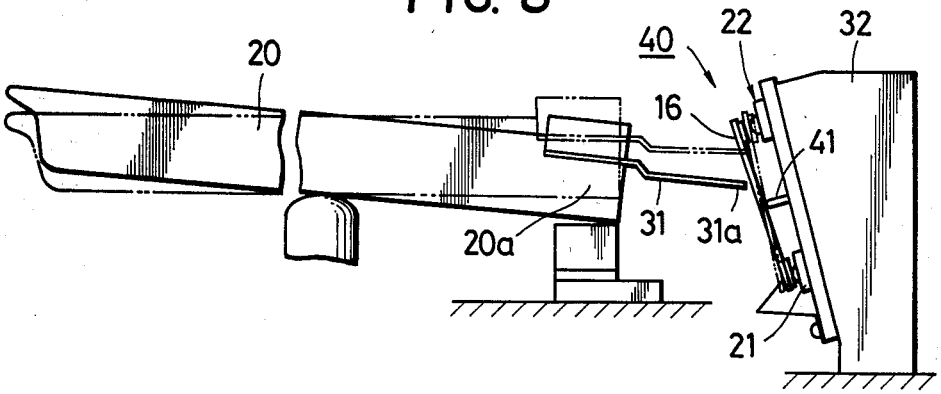
FIG. 8 is a partial view similar to FIG. 5 but showing another embodiment of the invention installed in an electronic musical instrument.

FIG. 8 shows another embodiment of the touch response sensor of the key for the instrument employing the switch mechanism 40 as described and disclosed above, wherein the same component parts as those shown in FIGS. 5 are denoted by the same reference characters and description thereof is omitted.

In the state that the key 30 is not depressed, the actuator 31 is located at the end 16*d* of the drive piece 16 with respect to the supporting member 20 of the drive piece 16 at the end 31*a* thereof in slight gap facing with the drive piece 16, and the switch mechanism 40 is in the state as designated in FIG. 7. Accordingly, the switch mechanism 15 is so arranged that the switch 21 becomes on, while the switch 22 becomes off.

Upon depression of the key 30 the actuator 31 is rotated in counterclockwise direction, so that the end 31*a* of the actuator 31 is slidably moved to depress the drive piece 16 thereon as designated by two-dotted broken lines in FIG. 8. Accordingly, the drive piece 16 is reversely rotated in clockwise direction on the supporting member 41 as aforementioned to cause the switch 21 to become off, while the switch 22 becomes on.

The time period T from the time point when the switch 21 becomes off the time point the switch 22 becomes on will vary in response to the rotating speed of the actuator 31, i.e., the strength of the key depressing operation of the key 30.

When the actuator 31 is slidably moved on the drive piece 16, it is moved against the spring 27 with the result that it receives the reaction by the spring 27.

Figure 9:
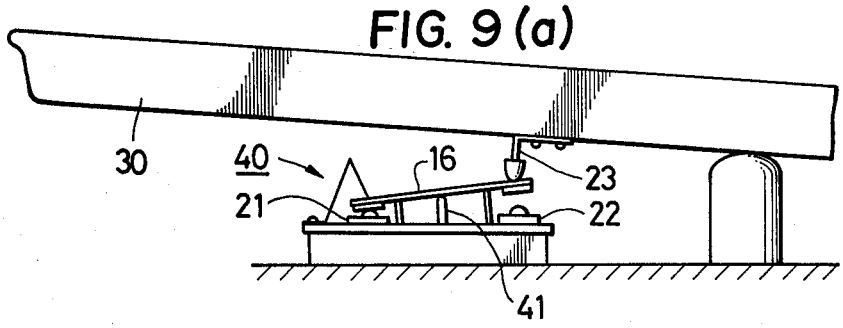
FIGS. 9(*a*) and 9(*b*) are views of still other installation arrangements for the sensor in FIG. 7.
Figure 9:
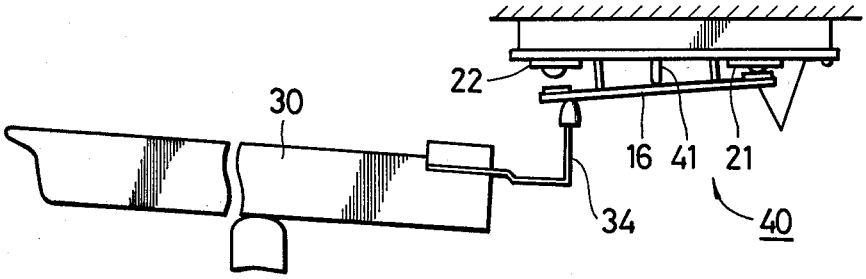

FIGS. 9(*a*) and 9(*b*) show another embodiment of the touch response sensor, wherein the same component parts as those shown in FIGS. 6(*a*) and 6(*b*), are denoted by the same reference characters and description thereof is omitted.

It should be understood from the foregoing description that since the stroke of the drive piece of the time from when the first switch becomes off to when the second switch becomes on can extremely accurately detect the contact time difference, the sensor of this invention may provide a preferred initial control. It should also be understood that the construction of the sensor of this invention is very simplified in construction and that the manufacturing, assembling and check and maintenance are very easy. Further, it is also appreciated tha the respective parts of the sensor may be manufactured by mass production in high accuracy. In addition, it is also to be noted that the chattering of the switches caused by switching operation may be prevented completely.

Figure 10:
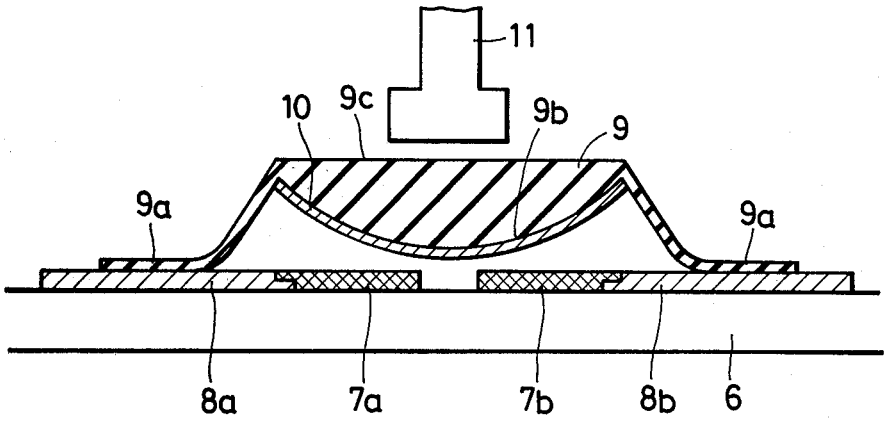
FIG. 10(*a*) is a sectional view of another embodiment of the switch in the touch response sensor for an electronic musical instrument to the present invention.
Figure 10:
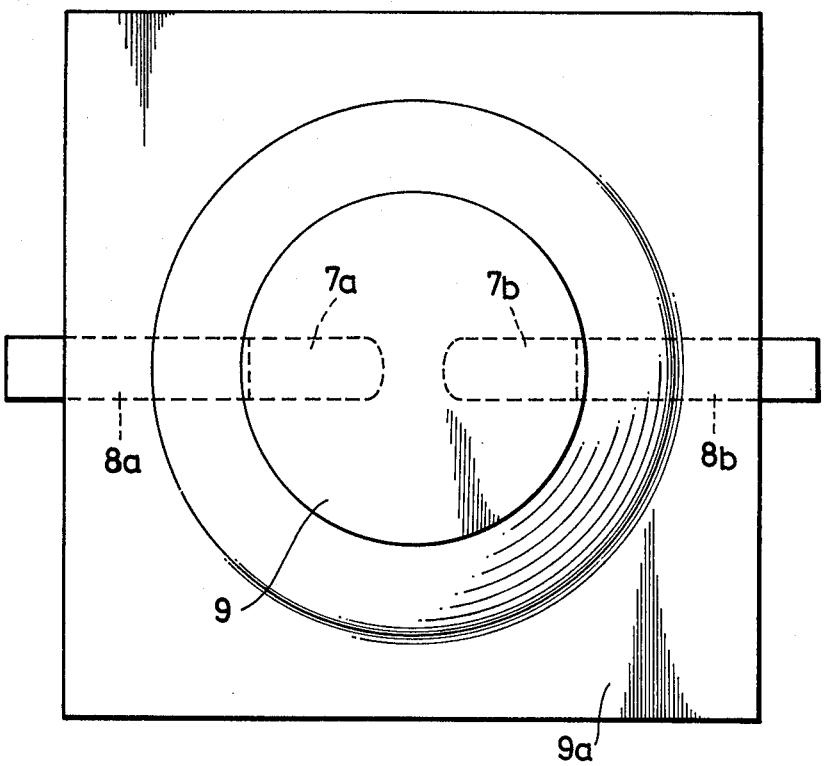

FIGS. 10(*a*) and 10(*b*) show one preferred embodiment of a switch element in the touch response sensor for an electronic musical instrument constructed according to the present invention and being switable for the switch 22 in the switch mechanisms shown in FIGS. 2 and 7 to conduct the after-control effect. The touch response sensor of this invention comprises two electrically resistant or resistance members 7*a* and 7*b* arranged in a predetermined space on a base plate 6, which members 7*a* and 7*b* are made extremely thinner than the thickness of the base plate 6 and are formed of a thin plate of uniform resistance value or a predetermined resistance distribution, and are connected at one respective ends to stationary conductive members 8*a* and 8*b* arranged on the base plate 6. The sensor of this embodiment also comprises a resilient member 9 of substantially truncated conical or frusto-conical configuration arranged in such a manner that the peripheral portion 9*a* thereof is fixedly secured or adhered onto the base plate 6 such as by an adhesive or the like. The resilient member 9 is made of synthetic resin or the like such as, for example, vinyl chloride, or the like being soft and having sufficient resiliency or elastic property.

A movable electrically conductive member 10 is mounted underneath the lower spherical surface 9*b* of the resilient meb member 9 facing with the resistant members 7*a* and 7*b* and is extremely thinner than the thickness of the resilient member 9 such as made, for example, of flexible rubber or the like.

There is further provided an actuator 11 above the resilient member 9 in cooperation with the depression of the key for the electronic musical instrument (not shown), and this actuator 11 depresses the top portion 9*c* of the resilient member 9 upon depression of the key.

When the resilient member 9 is depressed by the actuator 11, it is deformed with the result that the movable conductive member 10 is contacted to the aforesaid two resistant members 7*a* and 7*b*. The contacting area of the conductive member 10 with the resistant members 7*a* and 7*b* in the above state is determined by the depressing pressure of the resilient member 9 and the depressing pressure of the resilient member 9 is determined by the depressing pressure of the key cooperated with the actuator 11. Accordingly, the resistance value between the stationary conductive members 8*a* and 8*b* will vary in response to the depressing pressure of the key.

Assuming, accordingly, that electric power source is for example connected to one end of the stationary conductive member 8*a*, an electric current varying in response to the depressing pressure of the key can be delivered from the stationary conductive member 8*b*.

The operation of the sensor thus constructed will now be described with reference to FIG. 11, which shows a sectional side view of the touch response sensor of this embodiment in operation.

Assume that the key (not shown) of the instrument is not depressed, whereupon the actuator 11 cooperated with the key will not accordingly depress the resilient member 9, the movable conductive member 10 is separated from the two resistant members 7*a* and 7*b*. As a result, any current will not flow through the stationary conductive members 8*a* and 8*b*.

Figure 11:
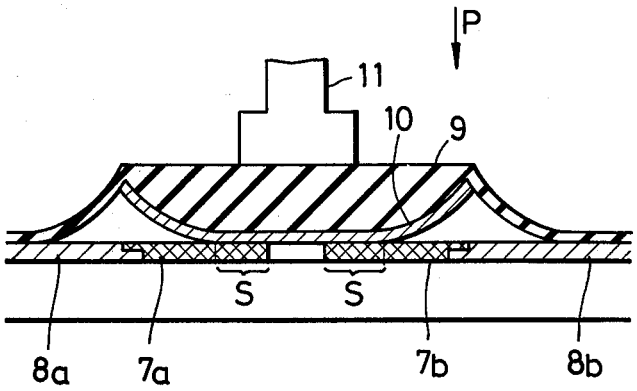
FIG. 11 is a sectional view of the switch shown in FIGS. 10(*a*) and 10(*b*) for explaining the operation thereof.

Upon depression of the key, the actuator 11 will move in the direction as designated by an arrow P in FIG. 11 in cooperation with the key so as to depress the resilient member 9 by a predetermined amount. Thus, the conductive member 10 will simultaneously contact the two resistant members 7a and 7b so as to form an electric circuit through the conductive member 10 between the resistant members 7a and 7b. In this connection the maximum contacting area of the conductive member 10 with the resistant members 7a and 7b is determined by the depressing amount of the actuator 11 and accordingly the key depressing pressure.

Assuming now that the conductive member 10 is contacted with the portions as designated by S in FIG. 11 of the resistant members 7a and 7b as shown, the resistance between the conductive members 8a and 8b becomes the value reduced by the amount proportional to the area of the contacting portions S.

Upon release of the key thus depressed, the actuator 11 will move in the direction opposite to the arrow P in FIG. 11 so that the resilient member 9 will thus reduce the contacting area of the conductive member 10 with resistant members 7a and 7b by means of the resilient tension thereof. The resilient member 10 will return to its original position thereby separating the conductive member 10 from the resistant members 7a and 7b.

It should be understood from the foregoing description that since the sensor of this invention is thus constructed and operated, the resistance between the stationary conductive members 8a and 8b will vary in response to the key depressing pressure of the instrument, so that the sensor will produce a signal responsive to the key depressing pressure necessary for adding a touch response effect by utilizing the aforementioned resistance variations.

It is to be noted that since the varied amount of the resistance between the conductive members 8a and 8b depends upon the resistance value per predetermined length of the resistant members 7a and 7b and the resilient tension and shape of the resilient member 9 in the aforementioned embodiment, it may be selectively determined with proper materials as required.

Figure 12A:
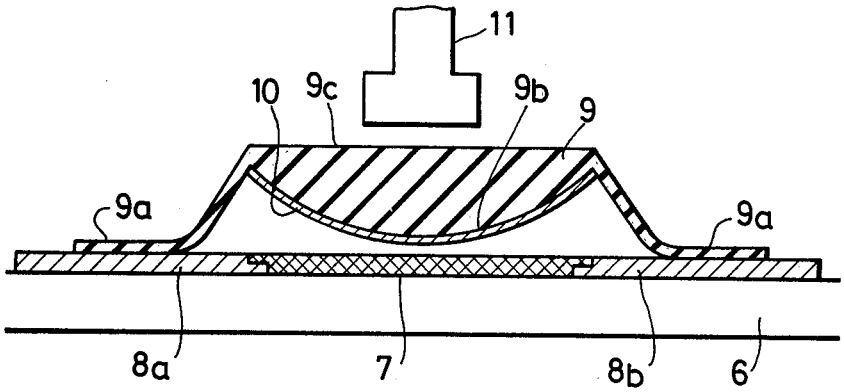
FIGS. 12(*a*) and 12(*b*) are sectional and plan views of the switch of this invention similar to FIGS. 10(*a*) and 10(*b*) but showing another embodiment thereof.
Figure 12B:
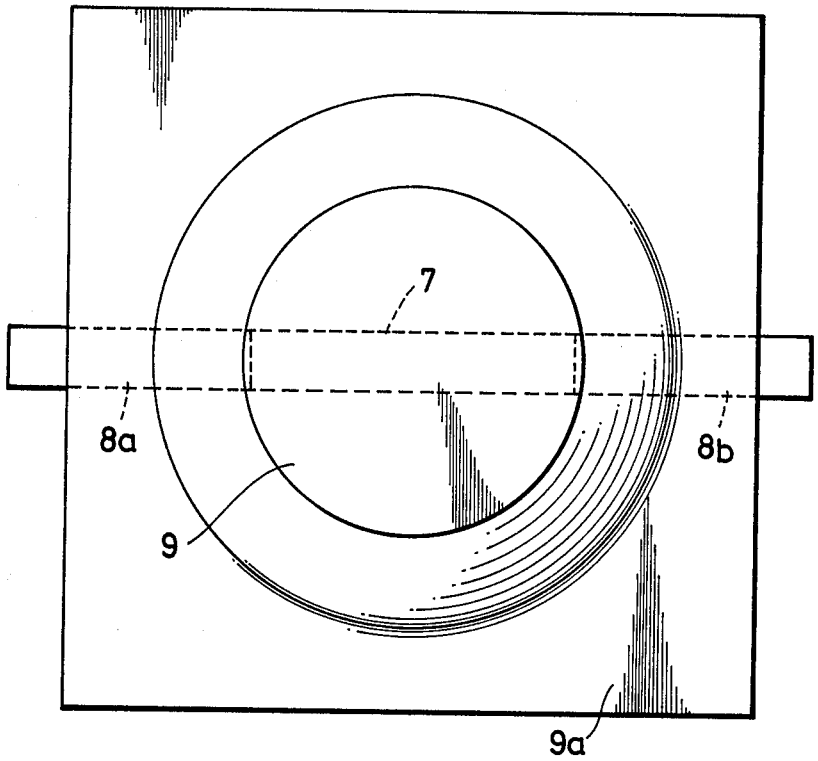

FIGS. 12 show another embodiment of the switch element in the touch response sensor of this invention, wherein the same component parts as those shown in FIGS. 10 are denoted by the same reference characters and description thereof is omitted.

The sensor of this embodiment comprises a resistant or resistance member 7 arranged on the base plate 6, which member 7 is connected at both ends thereof to stationary conductive members 8a and 8b on the base plate 6 and which has a sufficiently high resistance value. The resilient member 9 is made, for example, of silicon rubber or the like being soft and having sufficient resiliency or elastic property.

Upon depression of the key the resistance value between the stationary conductive members 8a and 8b will vary in response to the depressing pressure of the key. More particularly, as the key depressing pressure is increased, the resistance value therebetween will become descreased.

It will be understood that the sensor of this embodiment can produce a signal varying responsive to the key depressing pressure by utilizing the resistance variations of the resistant member 7.

The operation of the sensor thus constructed will now be described with reference to FIG. 13, which shows a sectional side view of the sensor of this embodiment.

Assume that the key (not shown) of the instrument is not depressed, whereupon the actuator 11 cooperated with the key will not accordingly depress the resilient member 9, so that the movable conductive member 10 is separated from the resistant member 7. As a result, the resistance value between the stationary conductive members 8a and 8b becomes a predetermined value.

Figure 13:
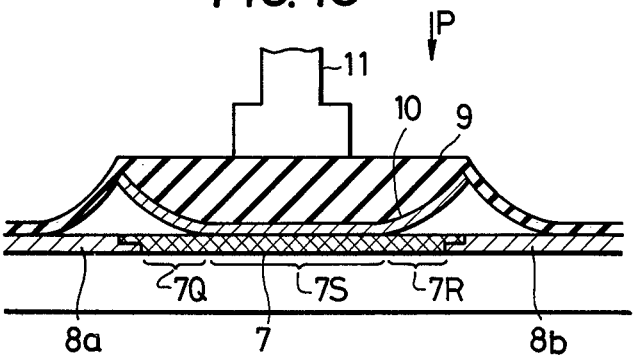
FIGS. 13 is a sectional view similar to FIG. 11 but showing another embodiment of the invention.

Upon depression of the key, the actuator 11 will move in the direction as designated by an arrow P in FIG. 13 in cooperation with the key so as to depress the resilient member 9 by a predetermined amount, i.e., by the amount responsive to the key depressing pressure. Thus, the conductive member 10 will come into contact with the resistant member 7. The contacting area of the conductive member 10 with the resistant member 7 is determined by the depressing amount of the actuator 11 and accordingly the key depressing pressure.

Assuming now that the conductive member 10 is contacted with the resistant member 7 in such a manner that the contacting portion of the conductive member 10 with the resistance member 7 is represented by 7S while non-contacting portions of the member 10 with the member 7 are by 7Q and 7R as shown, an electric circuit will be formed through the resistance portion 7Q, the movable conductive member 10 and the resistance portion 7R between the stationary conductive members 8a and 8b with the result that the resistance value between the conductive members 8a and 8b becomes the value reduced by the amount proportional to the area of the contacting portion 7S of the resistant member 7. Therefore, the resistance between the conductive members 8a and 8b, i.e., the resistance value of the resistant member 7 becomes the value responsive to the key depressing pressure.

Upon release of the key thus depressed the actuator 11 will move in the direction opposite to the arrow P in FIG. 13, so that the resilient member 9 will thus return to the original position by means of the resilient tension thereof thereby separating the conductive member 10 from the resistant member 7.

It should be understood from the foregoing description that since the sensor of this embodiment is thus constructed and operated, it may be extremely miniaturized, that as it may directly be mounted onto the base plate or substrate, its electric circuit may be simplified and with less expensive production cost.

It should be noted that when either of the switch elements shown in FIGS. 10 and 12 is used as a switch 22 in the switch mechanism shown in FIGS. 2 and 7, the after-control is effectively conducted.

What is claimed is:

1. A touch response sensor for an electronic musical instrument having a plurality of keys, comprising:

first and second switches located with a predetermined space therebetween on a base plate, each of said first and second switches including a resilient member made of elastomeric material with a movable contact on a lower surface thereof and at least one stationary contact located under said movable contact;

a common drive piece provided on said base plate to oppose an upper surface of said resilient member in each of said first and second switches and being rotatable on said base plate in accordance with depression of a key; and a spring action on said drive piece to urge the drive piece to an initial position thereof where it is closer to said first switch than to said second switch, said first switch and said second switch being successively operated by said drive piece upon rotation of the drive piece against the force of said spring when the key is depressed.

2. A touch response sensor according to claim 1, in which said spring urges one end of said drive piece onto said base plate, the drive piece being firstly rotated around said one end thereof to operate said first switch and subsequently rotated around the first switch to operate said second switch.

3. A touch response sensor according to claim 1, further comprising a fulcrum member arranged on said base plate between said first and second switches to support said drive piece rotatively around said fulcrum member.

4. A touch response sensor according to claim 1, in which said drive piece includes at least one projection extending toward the base plate, said base plate including at least one bore facing said projection to receive the latter for guiding the rotational movement of the drive piece.

5. A touch response sensor according to claim 1, in which at least one of said first and second switches has its stationary contact formed of two contact members spaced from each other and its movable contact extending over said two contact members.

6. A touch response sensor according to claim 1, in which said second switch has its movable contact made of material that is highly electrically conductive and curved to be convex toward the stationary contact which is made of electrically resistive material, said movable contact being deformable when depressed against said stationary contact by said drive piece, thereby varying the contacting area of said stationary contact with said movable contact in accordance with the pressure of the key depression.

7. A touch response sensor according to claim 6, in which said stationary contact of the second switch includes two contact members spaced from each other and both made of electrically resistive material, said movable contact of the second switch extending over said two contact members.

* * * * *